United States Patent [19]

Hussien et al.

[11] Patent Number: 4,906,013

[45] Date of Patent: Mar. 6, 1990

[54] QUICK FASTENER ICE SKATE APPARATUS

[76] Inventors: Jeff Hussien, 46 Vet's Mem. Dr., Peabody, Mass. 01960; Edgar L. Peguero, 22 Wyman St., Lynn, Mass. 01905

[21] Appl. No.: 286,609

[22] Filed: Dec. 19, 1988

[51] Int. Cl.[4] ..... A63C 1/26

[52] U.S. Cl. ..... 280/11.12; 36/97

[58] Field of Search ..... 280/11.12, 11.18, 11.3, 280/11.34, 811, 11.32, 11.33; 36/97, 115

[56] References Cited

U.S. PATENT DOCUMENTS

| | | | |
|---|---|---|---|
| 2,867,445 | 1/1959 | Lachat | 280/11.12 |
| 3,061,324 | 10/1962 | Murray | 280/11.12 |
| 4,126,323 | 11/1978 | Scherz | 280/11.12 |
| 4,351,537 | 9/1982 | Seidel | 280/11.12 |
| 4,655,465 | 4/1987 | Schaeffer | 280/11.12 |

*Primary Examiner*—Charles A. Marmor
*Assistant Examiner*—Richard Camby
*Attorney, Agent, or Firm*—Leon Gilden

[57] ABSTRACT

A quick fastener ice skate apparatus is set forth wherein an ice skate organization is formed with a conventional downwardly projecting blade formed with an uppermost end thereof securable by an elongate hook and loop fastener organization, and further including a series of serrated straps overlying the forward portion of the skate to secure the ice skate together wherein each fastener includes an elongate serrated strap positionable through a bridge member. Each bridge member includes a downwardly pivotally biased detent wherein the serrated strap, when pulled through the bridge member, is prevented from withdrawing from the bridge member by the detent wedged into a depression between respective serrated portions of the strap. Additionally, a pouch includes a plurality of replaceable strap members to provide ready replacement of a respective strap upon breakage.

9 Claims, 1 Drawing Sheet

QUICK FASTENER ICE SKATE APPARATUS

BACKGROUND OF THE INVENTION

1. Field of the Invention

The field of invention relates to ice skates, and more particularly pertains to a new and improved quick fastener ice skate apparatus wherein each pair of an ice skate pair is provided with quick fastener means to enhance securement and removal of the respective ice skate.

2. Description of the Prior Art

The use of quick fastener ice skates and the like is known in the prior art, but heretofore the prior art has failed to provide an effective organization to enhance securement and removal of ice skates to a user. The instant invention attempts to overcome deficiencies of the prior art by providing selectively utilizable securement straps positionable within a readily accessible pocket formed to an associated ice skate to provide a selective supply of variously contoured serrated straps to accommodate various degrees of securement required by a user.

The prior art devices have heretofore failed to provide an organization as set forth by the instant invention. For example, U.S. Pat. No. 2,867,445 to Lachat sets forth an ice skate organization wherein conventional lacing and buckle strap arrangements are utilized for securement of an ice skate to a user.

U.S. Pat. No. 3,061,324 to Murray sets forth another example of a conventional lace arrangement for use in securement of an ice skate to a user wherein such arrangements are typically of a methodical and slow nature in the securement of an ice skate.

U.S. Pat. No. 4,126,323 to Scherz sets forth an ice skate provided with a plurality of band securement means to secure an ice skate to a user.

U.S. Pat. No. 4,351,537 to Seidel sets forth a multipart ice skate wherein Velcro straps are utilized to secure an ice skate to a user wherein the organization further provides a cover portion to fully enclose a sock and provide protection for the skater's foot.

U.S. Pat. No. 4,655,465 to Schaeffer sets forth a conventionally structured lace-type boot arrangement further provided with flexure slits to effect comfort to a wearer thereof.

As such, it may be appreciated that there is a continuing need for a new and improved quick fastener ice skate apparatus which addresses both the problems of speed of use and provision of selective fastening arrangements therefore, and in this respect the present invention substantially fulfills this need.

SUMMARY OF THE INVENTION

In view of the foregoing disadvantages inherent in the known types of ice skate securement arrangements now present in the prior art, the present invention provides a quick fastener ice skate apparatus wherein the same provides for an effective and selective utilization of various strap fasteners in combination with a detent pawl to provide for effective and comfortable securement of an ice skate to a wearer thereof. As such, the general purpose of the present invention, which will be described subsequently in greater detail, is to provide a new and improved quick fastener ice skate apparatus which has all the advantages of the prior art ice skate fastener apparatus and none of the disadvantages.

To attain this, the present invention comprises a quick fastener ice skate apparatus including a conventionally shaped ice skate boot formed with a downwardly depending ice skate blade. An uppermost band utilizing hook and loop fasteners secures an uppermost portion of a respective ice skate boot to a wearer wherein a series of serrated straps are rapidly and effectively secured within a bridge member provided with a pivoted detent pawl and wherein further, each respective ice skate of a pair includes a pocket containing a plurality of replaceable serrated straps of various geometrical serrations to vary the complementary engagement of the pawl and serrated strap to secure a respective ice skate boot to a wearer. Further, the pawl is resiliently biased downwardly into engagement with a respective strap wherein a release member is secured to an uppermost surface of the pawl and projects upwardly through the bridge member where upward force applied to the pawl retracts the pawl from interengagement with the respective strap to enable release of the strap from within the bridge member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved quick fastener ice skate apparatus which has all the advantages of the prior art ice skate fastener apparatus and none of the disadvantages.

It is another object of the present invention to provide a new and improved quick fastener ice skate apparatus which may be easily and efficiently manufactured and marketed.

It is a further object of the present invention to provide a new and improved quick fastener ice skate apparatus which is of a durable and reliable construction.

An even further object of the present invention is to provide a new and improved quick fastener ice skate apparatus which is susceptible of a low cost of manufacture with regard to both materials and labor, and which accordingly is then susceptible of low prices of sale to the consuming public, thereby making such quick fastener ice skate apparatus economically available to the buying public.

Still yet another object of the present invention is to provide a new and improved quick fastener ice skate apparatus which provides in the apparatuses and methods of the prior art some of the advantages thereof, while simultaneously overcoming some of the disadvantages normally associated therewith.

Still another object of the present invention is to provide a new and improved quick fastener ice skate apparatus wherein the same provides for selective application of variously configured serrated straps utilized with a respective ice skate boot for rapid securement and disengagement to enable rapid securement and removal of an associated ice skate to a wearer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
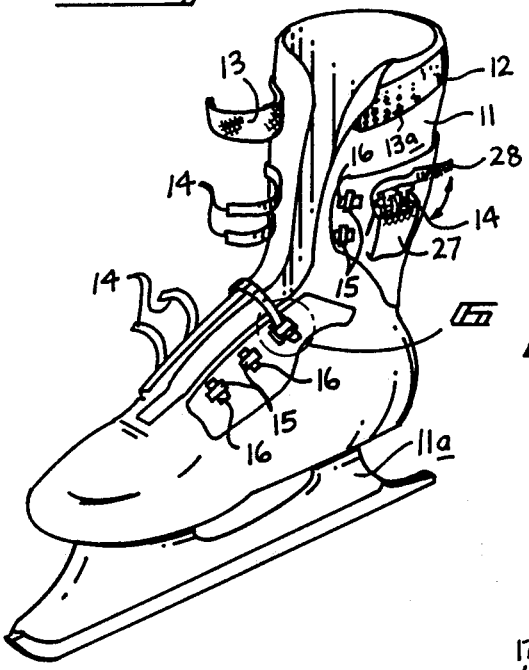
FIG. 1 is an isometric illustration of the instant invention.

With reference now to the drawings, and in particular to FIGS. 1 to 6 thereof, a new and improved quick fastener ice skate apparatus embodying the principles and concepts of the present invention and generally designated by the reference numeral 10 will be described.

More specifically, it will be noted that the quick fastener ice skate apparatus 10 essentially comprises an ice skate shoe 11 formed with a downwardly projecting ice skate blade 11*a*. A circumferential belt 20 is secured proximate an uppermost portion of the shoe and formed with hook and loop fastener ends 13 and 13*a* for securement of an uppermost portion of the shoe about a wearer. The remainder of the fastening system of the shoe about a wearer comprises a series of serrated strap members 14 pivotally secured to one side at the entrance slit of the shoe with a like number of bridge members 15 accepting free ends of the serrated strap members therethrough.

The bridge members 15 are fixedly secured overlying metallic planar support surface members 16 fixedly secured to the shoe and aligned with the respective strap members 14.

Each of the bridge members 14 is formed as a generally "U" shaped member with outwardly depending legs secured into the metallic support member 16. Secured to an interior side of bridge member 15 parallel to a respective metallic support member 16 is a pawl support 17. Each pawl support 17 is pivotally secured by means of an elongate pivot hinge 18 to a pawl 20 along an interface 19. The interface 19 between the pawl support and respective pawl 20 is at a generally 30 and 45 degree angle relative to the lower faces of respective pawl support 17 and wherein each pawl support 17 is provided with a relief notch 17*a* overlying a respective hinge 18 to enable upward pivotment of a respective pawl 20 relative to a pawl support 17.

Figure 5:
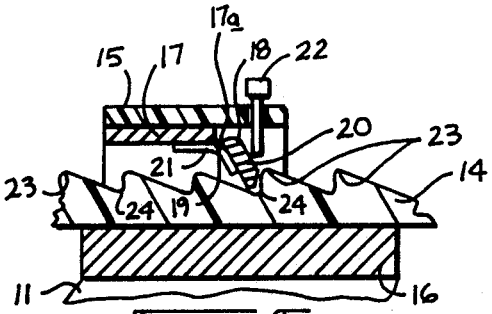
FIG. 5 is an orthographic view taken in elevation of the strap securement arrangement of FIG. 1.
Figure 3:
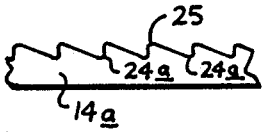
FIG. 3 is an orthographic view taken in elevation of a modified serrated strap utilized by the instant invention.

A respective strap 14 is received between the pawl 20 and pawl support 17 and pulled therethrough, as illustrated in FIG. 5, wherein due to the upward pivoting capability of a respective pawl 20, the strap 14 is allowed to ratchet itself until tightened whereupon release of the strap 14 forces engagement between the pawl 20 and pawl support 17 along interface 19 and arrests rearward movement of respective strap 14 by engagement of a forward tip of the pawl 20 with a trough 24 of a respective strap 14. Each trough 24 is formed of a complementary cavity configuration relative to the forward end of a respective pawl 20 for secure engagement therewith. The space between the respective pawl support 17 and a peak 23 of a respective strap 14 is approximately equal to the thickness of the pawl 20 to enable each pawl 20 to be pulled upwardly by means of a "T" shaped lift bar 22 extending through the bridge member 15 and attached to the upper surface of a respective pawl 20 to enable lifting of a pawl 20 for engagement within a strap 14 and enable thereby an easy removal of a strap 14 from within a bridge member 15. An elongate leaf spring 21 extending underlying the interface 19 between the junctures of the pawl supports 17 and pawls 20 bias the pawls 20 in a normally downward position, as illustrated in FIG. 5. FIG. 3 illustrates a strap 14*a* formed with hyperbolic peaks 27 overlying and extending beyond respective troughs 24*a* to effect an enhanced securement of a respective pawl 20 within a trough 24*a* and provide less potential shift of the strap 14*a* relative to a bridge member 15 when secured therethrough.

Figure 4:
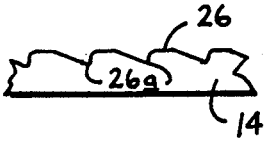
FIG. 4 is an orthographic view taken in elevation of a further modification of a serrated strap utilized by the instant invention.

Alternatively, as illustrated in FIG. 4, the peaks are formed as arcuate peaks 26 overlying respective troughs 26*a* formed of elongate planar floor surfaces to enable movement of a respective pawl 20 with respect to the trough 26*a* and thereby allow flexure to a respective strap 14*b* with respect to an associated bridge member 15.

The various straps, as illustrated in FIGS. 3, 4, and 5, are positioned within a pocket 27 fixedly secured to an exterior side a respective shoe 11 to enable selective utilization of respective straps, as desired by a user of the skate. The pocket 27 is formed with an overlying cover flap 28 formed with hook and loop fasteners to selectively secure the pocket flap 28 overlying a pocket 27.

Figure 2:
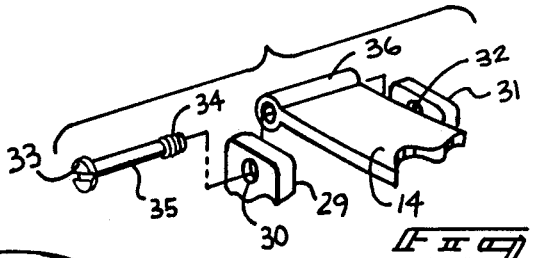
FIG. 2 is an isometric detailed exploded view of a pivot connection of a respective ice skate serrated strap to a respective ice skate mounting arrangement.
Figure 6:
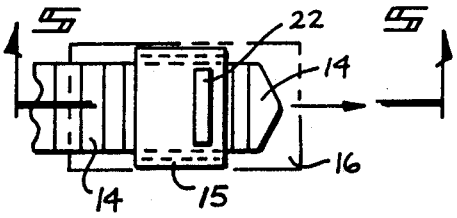
FIG. 6 is a top orthographic view of the strap securement arrangement.

FIG. 2 illustrates the manner of pivotal securement of a respective end of a strap 14 to the shoe 11. Particularly a first flange 29 is provided with a through-extending aperture 30 wherein said first flange is spaced parallel to a second flange 31 formed with a threaded aperture 32 axially aligned with the aperture 30. An elongate axle connector 33 extends through the aperture 30 and through a loop formed at the lowermost terminal end of a respective strap 14 and is thereafter threadedly fastened into the threaded aperture 32 wherein the smooth shank of the connector 33 is of a length substantially equal to the combined length of the aperture 30 and the loop 36 to enable smooth pivotment of the strap 14 relative to the connector 33.

As to the manner of usage and operation of the instant invention, the same should be apparent from the above disclosure and accordingly no further discussion relative to the manner of usage and operation of the instant invention shall be set forth.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An ice skate fastening system comprising, an ice skate blade rigidly secured to an underlying surface of an adjoining ice skate boot, and fastening means for fastening said boot to a user thereof including a circumferential band positioned proximate an upper terminal end of said boot and securable to itself in an overlapped orientation including cooperating hook and loop fasteners formed on opposed ends of said band, and a plurality of spaced straps pivotally mounted to one side of said boot and securable within coupling means positioned on an opposed side of said boot for securedly accepting said straps therethrough, and wherein said straps are formed with a serrated upwardly extending surface, and wherein said coupling means includes a generally "U" shaped bridge member formed with downwardly depending legs fixedly secured within a planar metallic backing surface, and said backing surface is fixedly secured to an upper surface of said boot and said "U" shaped bridge member is aligned with a respective strap, and wherein each bridge member includes a pawl support pivotally mounting a downwardly directed pawl thereto wherein said pawl is pivotally mounted to said pawl support by an elongate hinge, and an elongate spring cooperatively mounted to said pawl support and pawl, and normally biasing said pawl in a downward orientation relative to said pawl support, and wherein said pawl is receivable within a trough between peaks of one of said serrated straps.

2. An ice skate fastening system as set forth in claim 1 wherein a spacing defined between a peak positioned within said bridge member is approximately equal to a thickness defined by said pawl.

3. An ice skate fastening system as set forth in claim 2 wherein a lift bar is mounted to an upper surface of said pawl and projects upwardly through said bridge member for grasping by a user to withdraw engagement of said pawl with respect to an associated serrated strap.

4. An ice skate fastening system as set forth in claim 3 wherein serrations formed on said strap include hyperbolic peaks overlying arcuate troughs and wherein said troughs are of complementary configuration to a forwardmost portion of said pawl for complementary interengagement therewith.

5. An ice skate fastening system as set forth in claim 3 wherein said peaks are arcuate and spaced above planar troughs to enable relative movement between said pawl and said strap.

6. An ice skate fastening system as set forth in claim 4 wherein a pocket is mounted to an exterior surface of said boot and is formed with an overlying flap including hook and loop fasteners, and a plurality of strap members are securable within said pocket as replacement for a strap utilized with said boot.

7. An ice skate fastening system as set forth in claim 6 wherein an interface between said pawl support and said pawl is defined by a surface at an angle 30 to 45 degrees relative to an underlying surface of said pawl support.

8. An ice skate fastening system as set forth in claim 7 wherein a recessed notch is formed on said pawl support overlying said hinge to enable said pawl to pivot upwardly relative to said pawl support.

9. An ice skate fastening system as set forth in claim 8 wherein each strap is pivotally mounted to said boot including a plurality of spaced first and second flanges, and said first flange is formed with a through-extending smooth aperture, and said second flange is formed with a threaded aperture, and a terminal end of each strap is formed with a loop, and an elongate axial fastener is formed with a smooth shank of a length equal to a thickness defined by said first flange and a length defined by said loop, and said fastener is formed with a threaded end for securement through said first flange, said loop, and into said second flange.

* * * * *